United States Patent [19]

Lackner et al.

[11] Patent Number: 5,057,131

[45] Date of Patent: Oct. 15, 1991

[54] VACUUM CLEANER FILTER BAG ASSEMBLY

[75] Inventors: John R. Lackner, North Ridgeville; Stanley E. Grzywna, Elyria, both of Ohio

[73] Assignee: The Scott Fetzer Company, Westlake, Ohio

[21] Appl. No.: 612,119

[22] Filed: Nov. 9, 1990

Related U.S. Application Data

[63] Continuation-in-part of Ser. No. 500,237, Mar. 26, 1990, abandoned, which is a continuation of Ser. No. 249,311, Sep. 26, 1988, abandoned.

[51] Int. Cl.[5] ..... B01D 46/00

[52] U.S. Cl. ..... 55/369; 15/347; 15/350; 55/371; 55/374; 55/378; 55/473; 285/7

[58] Field of Search ..... 15/347, 349, 350, 351; 55/369, 370, 371, 374, 375, 378, 473, DIG. 2; 285/7, 9.3, 914, 921

[56] References Cited

U.S. PATENT DOCUMENTS

| | | | |
|---|---|---|---|
| 1,422,105 | 7/1922 | Kirby | 55/367 |
| 2,460,851 | 2/1949 | Sheppard | 55/DIG. 2 |
| 3,429,107 | 2/1969 | Graves | 55/378 |
| 4,028,074 | 6/1977 | Schaaf | 55/371 |
| 4,084,948 | 4/1978 | MacFarland | 55/473 |
| 4,262,384 | 4/1981 | Bowers | 55/375 |
| 4,424,070 | 1/1984 | Robinson | 55/378 |
| 4,445,915 | 5/1984 | Robinson | 55/378 |
| 4,483,556 | 11/1984 | LiVolsi | 285/921 |
| 4,514,199 | 4/1985 | Ford et al. | 15/349 |
| 4,601,735 | 7/1986 | Morton, Jr. | 55/378 |
| 4,633,543 | 1/1987 | Sovis et al. | 15/344 |
| 4,791,699 | 12/1988 | Sovis et al. | 15/344 |

FOREIGN PATENT DOCUMENTS

| | | | |
|---|---|---|---|
| 1089530 | 9/1960 | Fed. Rep. of Germany | 55/369 |
| 3404080 | 8/1985 | Fed. Rep. of Germany | 55/378 |
| 1084048 | 4/1984 | U.S.S.R. | 55/378 |

*Primary Examiner*—Jay H. Woo
*Assistant Examiner*—C. Scott Bushey
*Attorney, Agent, or Firm*—Watts, Hoffmann, Fisher & Heinke Co.

[57] ABSTRACT

A permanent mounting assembly for a vacuum cleaner filter bag includes a plastic collar stitched to the porous body of the vacuum cleaner bag around the inlet opening thereof. The bag is mounted on the exterior surface of a projection on the vacuum cleaner housing. The exterior surface of the projection is provided with an annular groove. An interior rib on the collar is positioned within the groove to mechanically lock the bag on the projection of the housing. A nonelastic tie strap is positioned around the rib to permanently secure the rib in place and to provide a permanent fluidtight connection between the collar and the projection on the housing. The collar is provided with a band which is folded back to conceal the stitching, providing an attractive, neat appearance.

39 Claims, 4 Drawing Sheets

VACUUM CLEANER FILTER BAG ASSEMBLY

This is a continuation-in-part of application Ser. No. 07/500,237, filed 3/26/90, which in turn is a File Wrapper Continuing Application of Ser. No. 07/249,311, filed 9/26/90, both of which have been abandoned.

BACKGROUND OF THE INVENTION

This invention relates generally to vacuum cleaners and the like, and more particularly to a novel and improved filter bag structure and to a novel and improved structure for mounting such filter bag on the housing assembly of the vacuum cleaner.

PRIOR ART

Vacuum cleaners often provide an outer, nondisposable filter bag which is mounted on the vacuum cleaner housing assembly and which encloses a disposable filter bag. Such outer, nondisposable bags are generally provided with a zipper closed opening through which the disposable filter bags are installed and removed. Such nondisposable filters are normally not removed when the disposable inner bag is removed and replaced.

It is also known to provide nondisposable filter bags in which the dirt is collected. Such nondisposable bags are often removably mounted on the vacuum cleaner for continued use.

Non disposable filter bags are often provided with an elastic band around the entrance opening therein which fits into a groove formed in the vacuum cleaner housing assembly.

It is also known to provide a removable nondisposable filter bag with a collar or ring stitched to the filter bag body and which provides an internal rib which is positioned within a groove in the vacuum cleaner housing when the filter bag is mounted. An example of such a filter bag mounting structure is illustrated in U.S. Pat. No. 4,601,735.

SUMMARY OF THE INVENTION

The present invention provides a novel and improved mounting structure for mounting filter bags on a vacuum cleaner and the like. The filter bag is provided with a flexible, molded plastic collar which is mounted on a porous body of the bag around the entrance opening thereof. In the illustrated embodiment, the collar and bag proper are stitched together.

The collar is mounted on a projecting portion of the vacuum cleaner housing assembly. The projecting portion of the housing assembly and the collar are provided with an interfitting groove and rib structure which lock the collar on the projection. In the illustrated embodiment, the rib is formed on a collar and projects inwardly into a mating groove formed in the housing assembly.

A nonelastic tie strap encircles the collar around the interfitting rib and groove and produces a permanent mounting of the bag and housing assembly. The collar is provided with a flap which folds back over the stitching to conceal it from view. The resulting mounting structure provides a neat and attractive appearance. Since the illustrated embodiment is a nondisposable filter bag intended for use in combination with an interior disposable filter bag, the bag is not removed in the normal use of the vacuum cleaner, and a permanent mounting is provided.

In one illustrated embodiment, the tie strap is exteriorly mounted on the collar. In another illustrated embodiment, the collar is folded back over the tie strap and conceals both the stitching and the tie strap.

In both embodiments, a novel and improved low profile tie strap is provided to permanently mount the collar.

In the illustrated and preferred commercial embodiment, the groove in the housing contains three annular, raised projections. The collar is of substantially uniform thickness and has an indented portion corresponding to the groove. The inner surface of the indented portion is clamped against the projections to form a seal resembling a labyrinth seal. The collar is folded back over itself and the tie strap is mounted over the collar indented portion. The presence of the indented portion allows the strap to be flush and unobtrusive.

With this invention, a simple, low-cost mounting structure is provided which is attractive, durable, easily assembled, and satisfactory for extended use.

These and other aspects of this invention are illustrated in the accompanying drawings, and are more fully described in the following specification.

DETAILED DESCRIPTION OF THE DRAWINGS

Figure 1:
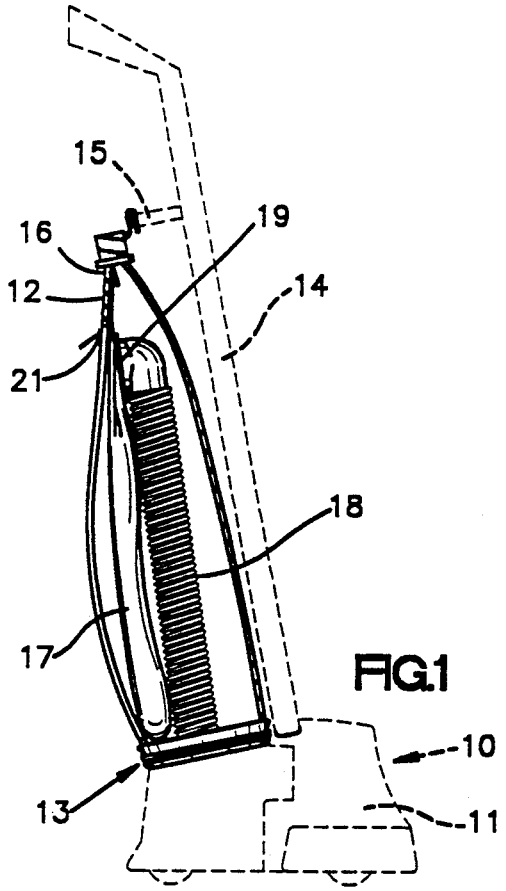
FIG. 1 is a schematic view of a vacuum cleaner with a nondisposable filter bag mounted thereon in accordance with the present invention.

FIG. 1 schematically illustrates one preferred embodiment of this invention. In this particular embodiment, an upright vacuum cleaner 10 provides a housing assembly 11 on which a nondisposable filter bag 12 is mounted by a mounting ring assembly 13. The vacuum cleaner provides an upstanding handle 14 having a bracket 15 to support the upper end 16 of the bag 12.

In this particular embodiment, the nondisposable bag 12 encloses a disposable filter bag 17 in which the dirt is entrapped during use of the vacuum cleaner. A flexible conduit 18 is provided through which the dirt-laden air passes from the housing assembly 11 to an inlet 19 in the disposable bag 17. The detachable mounting of the disposable bag 17 is disclosed and claimed in copending application Ser. No. 07/208,735, filed June 17, 1988 (assigned to the assignee of the present invention) and such application may be referred to for a detailed disclosure of the disposable bag and its mounting.

The nondisposable filter bag 12 is provided with a lengthwise extending zipper 21 so that the nondisposable bag can be opened to allow installation and removal of the disposable bag 17.

Figure 3:
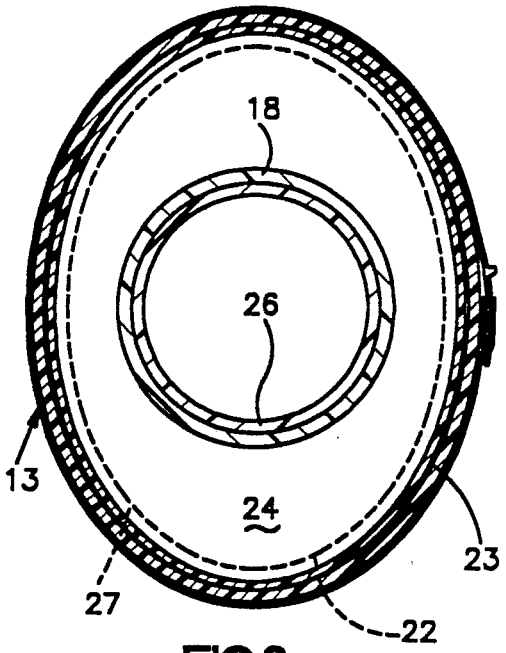
FIG. 3 is a cross section, taken along line 3—3 of FIG. 2.

Reference should now be made to FIGS. 2 through 7, which illustrate the structural detail of a first embodiment of the mounting of the nondisposable bag 12 on the associated portion of the housing 11. The housing 11 is provided with a projection 22 which is generally oval in shape, as illustrated in FIG. 3. Such projection provides a generally oval exterior wall 23 extending to a substantially planar wall portion 24. A cylindrical conduit portion 26 is centrally located within the wall and connects with the conduit 18. The dirt-laden air from the vacuum cleaner passes through the conduit portion 26 into the flexible conduit 18 and is then discharged into the disposable bag 17.

Immediately adjacent to the planar wall portion 24, the exterior wall 23 is formed with an annular groove 27 sized and shaped to receive an annular rib 28 on the interior of a collar 29 provided by the mounting ring assembly 13.

The collar 29 is preferably a molded plastic ring formed of, for example, flexible polyvinyl chloride (PVC). It may be molded in an annular shape, or may be formed by extrusion, with the ends of the extrusion suitably fastened together by adhesive or other means to form the required annular or ring shape.

Figure 4:
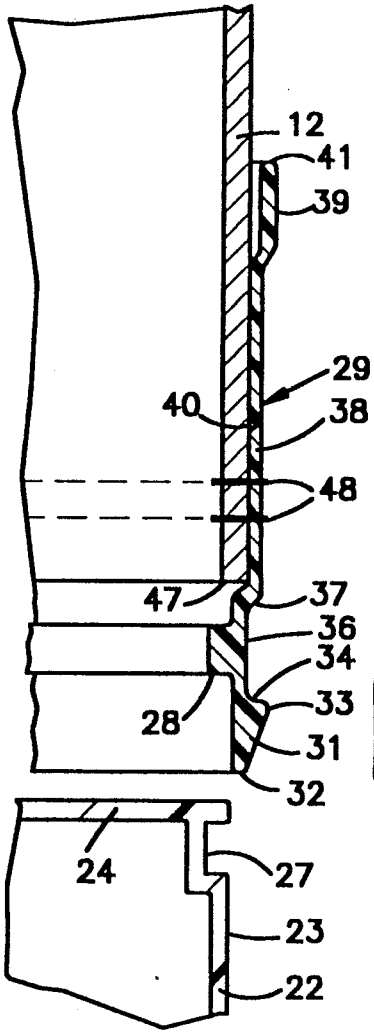
FIG. 4 is an exploded view of the mounting structure illustrating the filter bag prior to the being mounted on the vacuum cleaner housing.

As molded or formed, the collar 29 has a longitudinal cross section, best illustrated in FIG. 4. The collar consists of a tapered end portion 31 extending with increasing thickness from one end 32 of the collar to a location 33. Adjacent to the location 33, the collar cross section is reduced to provide one wall 34 of a recess 36. Interior of the recess, the collar provides the rib 28 which has a generally rectangular cross section sized and shaped to fit into the groove 27 with a close fit.

On the side of the recess 36 removed from the wall 34, the collar provides an outwardly extending wall portion 37 providing the opposite wall of the recess. From the wall portion 37, the collar provides a substantially uniform thickness annular wall portion 38 extending to an offset wall portion 39 at the opposite end 41 of the collar. Intermediate the ends of the wall portion 38, the inner surface of the collar provides a shallow groove 40 to facilitate the folding back of the collar, as discussed below.

Figure 7:
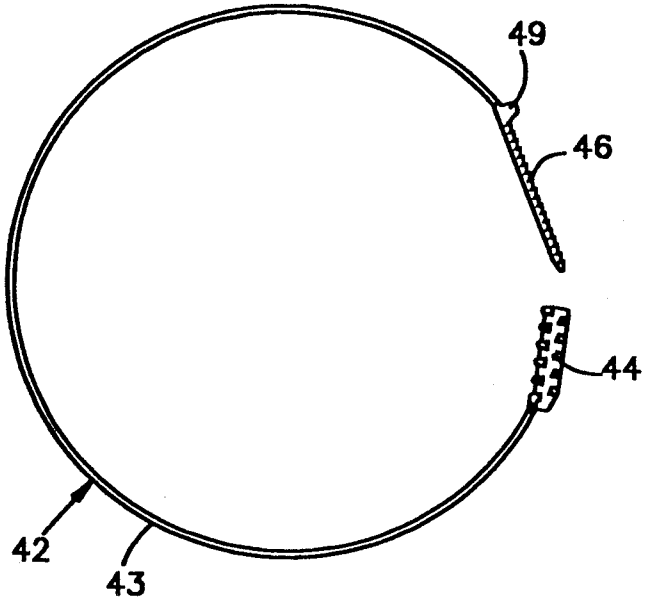
FIG. 7 illustrated the tie strap.
Figure 8A:
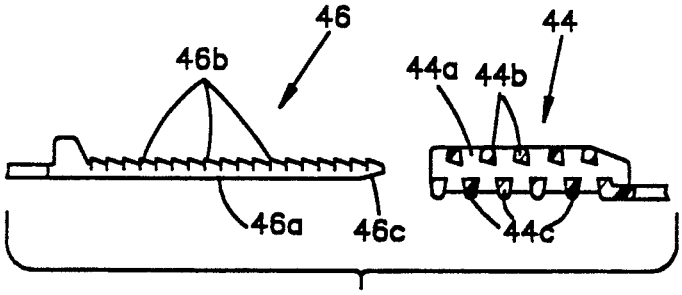
FIG. 8*a* is a enlarged side elevation, partially in section, of the two ends of the tie strap.
Figure 8B:
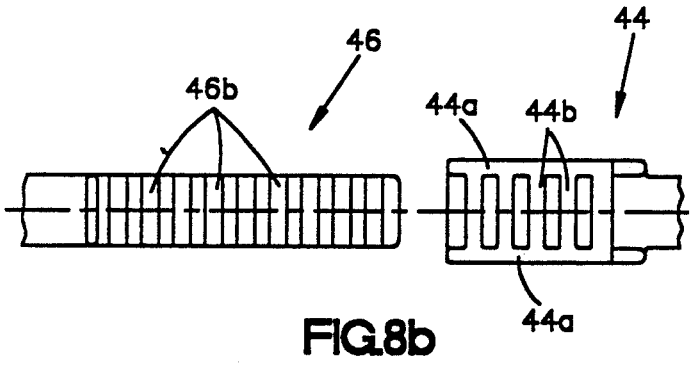
FIG. 8*b* is a plan view similar to FIG. 8*a;*

FIGS. 7, 8*a* and 8*b* illustrate a tie strap 42 which is used to permanently secure the collar on the housing 11. This tie strap is preferably molded from a nonelastic plastic material, such as nylon and the like, and provides a central band portion 43. At the ends of the central band portion 43, the tie strap provides a ratchet-type socket 44 at one end and a ratchet or serrated toothed end 46. The socket 44 and toothed end 46 are structured so that the toothed end 46 can easily be pressed into the socket, and once located within the socket a permanent connection is provided to form the tie strap 42 into a closed ring.

The socket end 44 provides two side portions 44*a* which support two arrays of lateral strap portions 44*b* and 44*c*. The array 44*b* provides a plurality of similar and spaced strap portions having inclined inner surfaces to provide a toothlike structure. The array 44*c* also includes a plurality of similar spaced strap portions having inner wall portions which are coplanar. The two arrays 44*a* and 44*b* are spaced apart and cooperate with the side portions 44*a* to provide a channel for the toothed end 46. The two arrays 44*b* and 44*c* are positioned so that the lateral strap portions 46*b* are aligned with the spaces between the strap portions 46*c* and vice versa.

The toothed end 46 provides a smooth wall 46*a* along one side and longitudinally spaced, lateral teeth 46*b* along the other side. The spacing between the teeth 46*b* is equal to the spacing between the lateral strap portions 44*b* and the end of the tooth end 46 is tapered at 46*c* to provide a thin end which can enter between the two arrays of strap portions 44*b* and 44*c*.

As the toothed end 46 is pressed in along the channel between the strap portions 44*b* and 44*c*, the teeth cam the strap portions apart until a position is reached in which the strap tightly grips the collar 29 and produces a seal between the collar 29 and the projection 22 of the housing 11. The teeth 46*b* then interlock with the strap portions 44*b* to hold the strap in such position.

The toothed end 46 is provided with a projection 49 to assist in installing the tie strap. Preferably a pliers-like tool is used to install and tighten the strap. One jaw of the tool engages the projection and the other jaw engages the ends of the side portions 44*a*. When the two jaws of the tool are moved toward each other, the toothed end 46 is moved along the socket end 44 and the strap is pulled tight.

This socket structure provides a low profile which is only a little more than three times the thickness of the central band portion 43. In the illustrated embodiment, the socket is about three and one-third times the thickness of the central band three times the thickness of the central band portion. Such low profile is desirable in this mounting system.

As illustrated in FIG. 4, the collar 29 is mounted on the end of the nondisposable filter bag 12 around the inlet opening 47 thereof by two rows of stitching 48. Such stitching is performed while the collar is in the as-formed condition extending along the exterior of the nondisposable bag 12 from the inlet opening 47 therein. Such stitching provides a permanent, secure connection between the bag and the collar per se. The end of the bag at the inlet opening 47 is substantially adjacent to the outwardly extending wall portion 37.

Figure 6:
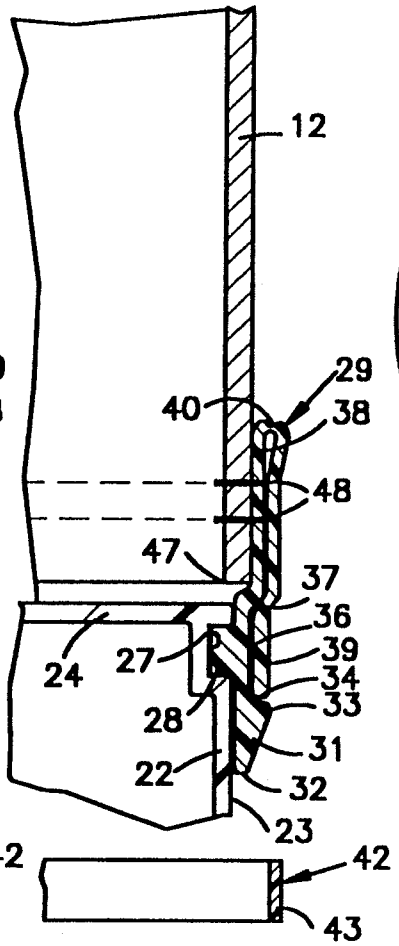
FIG. 6 is a cross section similar to FIGS. 4 and 5, illustrating the mounted filter bag after the collar is folded back and before installation of the strap.
Figure 5:
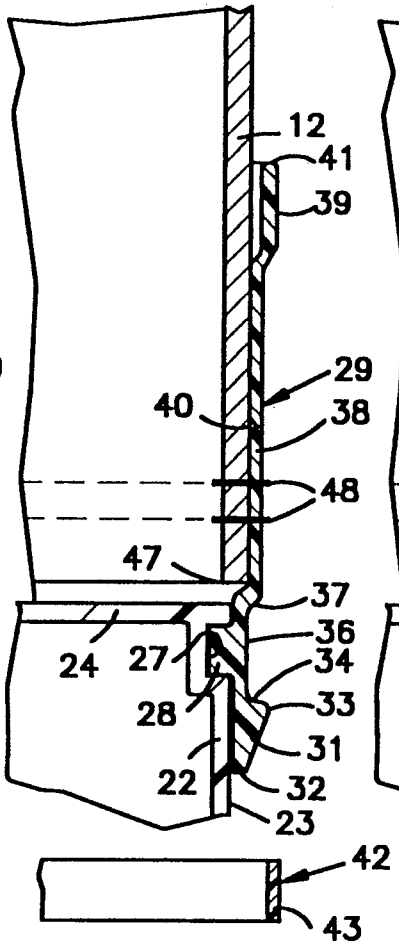
FIG. 5 is a longitudinal section similar to FIG. 4, but illustrating the filter bag in its mounted position on the vacuum cleaner housing and prior to the installation of the tie strap.

At the completion of the first step of assembly, the collar is positioned over the projection 22 of the housing assembly 11, as illustrated in FIG. 5. At this point in the assembly, the rib 28 is positioned within the groove 27. The collar is sized so that it closely fits the projection 22 and is formed of a material which is sufficiently flexible to allow it to be assembled into the illustrated position of FIG. 5. The collar is then folded back as illustrated in FIG. 6, and covers and conceals the stitching 48. In such condition, the offset portion 39 extends into the groove 36 around the rib 28.

Figure 2:
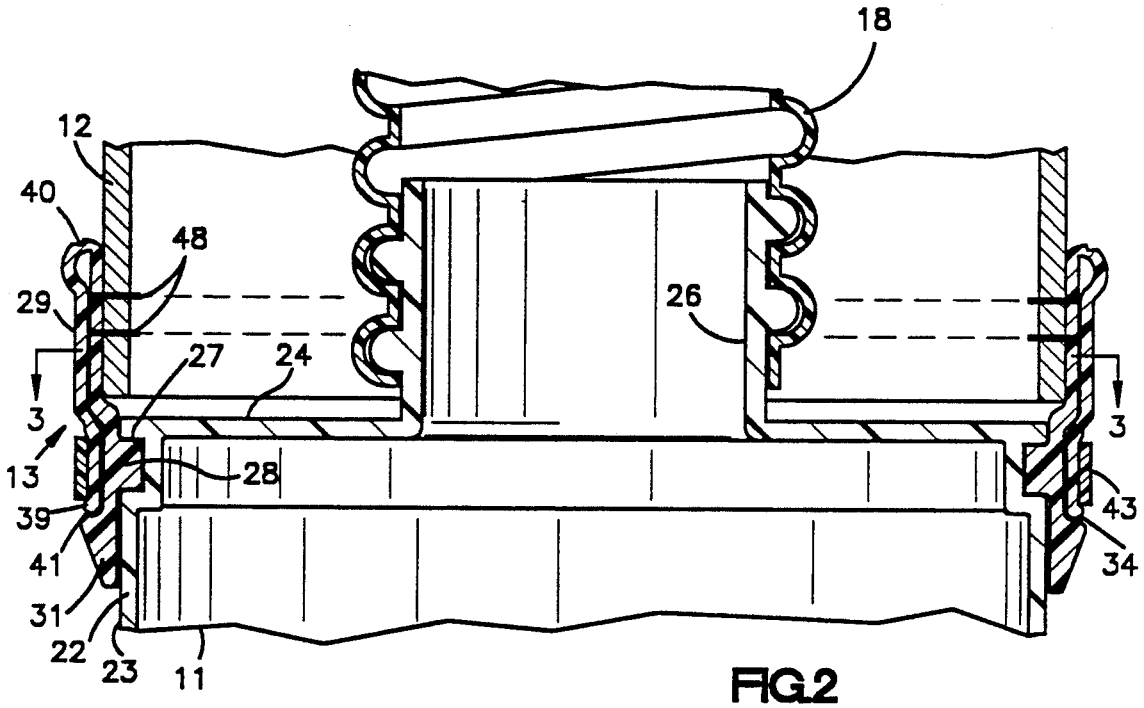
FIG. 2 is an enlarged longitudinal section through the bag mounting structure illustrating the bag in its mounted position on the housing assembly of the vacuum cleaner.

Thereafter, the tie strap 42 is positioned around offset portion 39 and around the rib 28. The toothed end 46 is inserted into the socket 44 and is pulled tight so that the strap 42 tightly encircles the collar and presses the collar into tight nonleaking contact with the exterior wall 23 of the projection 22. The tie strap cooperates with the rib 28 and groove structure 27 to provide a permanent, fluid-tight, interlocking joint between the collar and the projection 22. Preferably, the tie strap 42 is installed so that the connecting ends 44 and 46 are located in an obscure location around the periphery of the projection 22, where the connected ends are substantially concealed. The groove 40 provides a thinned section and forms a hinge structure so that a relatively tight fold is formed when the collar is folded back to conceal the stitching 48, as illustrated in FIG. 2.

Since the material forming the tie strap is nonelastic, a positive mechanical connection is provided between the collar and the housing assembly 11, which is easily assembled, is low in cost, and provides an attractive, durable connection. In normal use, the nondisposable bag is not removed from the cleaner, and if, for some reason, it is necessary to replace a damaged nondisposable filter bag 12, the tie strap is cut to allow the removal of the collar. In that event, a replacement nondisposable filter bag is merely reinstalled on the cleaner in the same way, utilizing the same type of tie strap 42.

Figure 10:
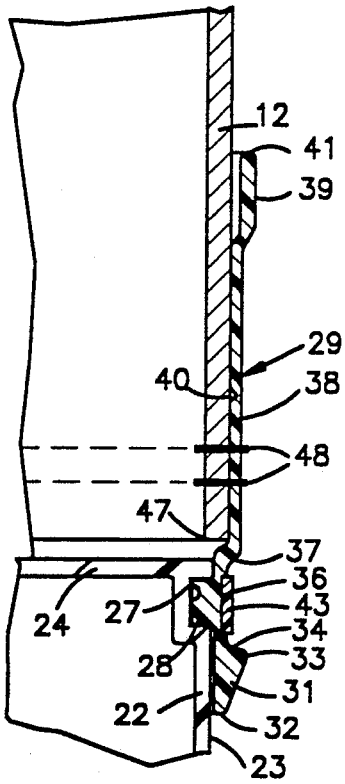
FIG. 10 is a partial, longitudinal section of the second embodiment before the collar is folded back to conceal the stitching and tie strap; and, FIG. 11 illustrates the preferred commercial embodiment and is a cross section similar to FIGS. 4, 5 and 6, illustrating the mounted filter bag after the collar is folded back.
Figure 9:
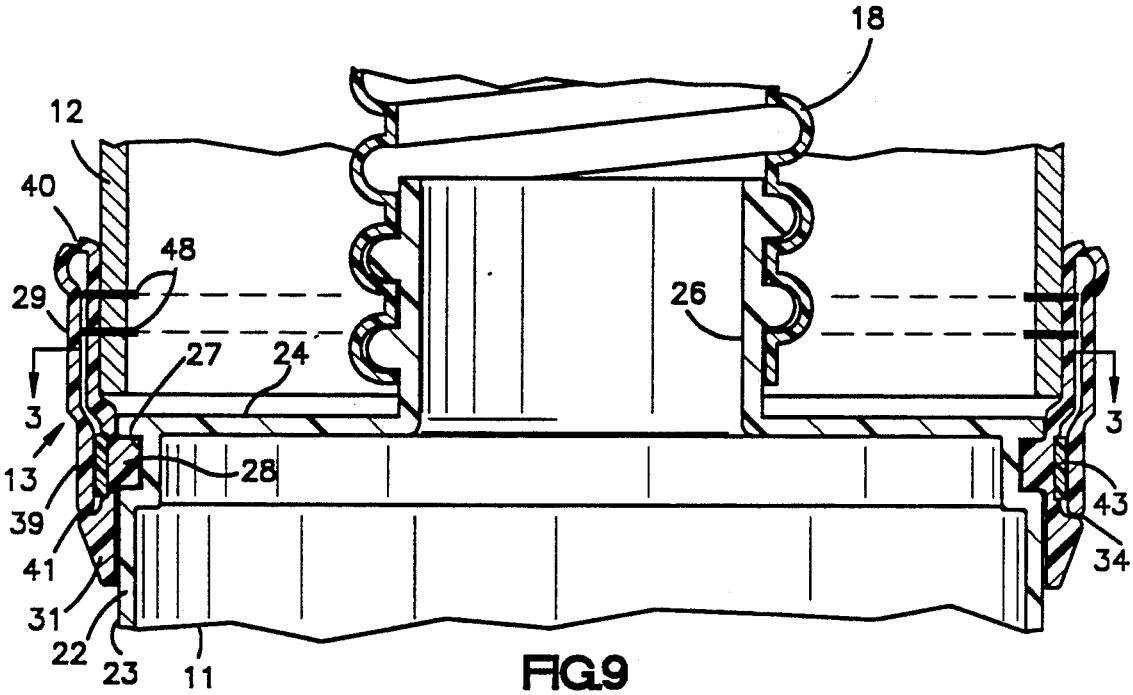
FIG. 9 is a longitudinal section similar to FIG. 2 but illustrating a second embodiment in which the collar also conceals the tie strap.

FIGS. 9 and 10 illustrate a second embodiment of this invention in which the tie strap is positioned in the groove 36 before the collar is folded back upon itself. In this embodiment, the portion of the collar which is folded back conceals both the stitching and the tie strap as illustrated in FIG. 9.

In this second embodiment, the collar 29 and the tie strap 42 have the same structure as in the first embodiment; therefore, the same reference numerals are used. The only difference between the second embodiment and the first embodiment is that in the second embodiment the tie strap 42 is installed in the groove or recess 36, as illustrated in FIG. 10, before the collar is folded back.

As the last step of assembly of this second embodiment, the portion of the collar remote form the end 32 is folded back over the stitching 48 and the tie strap 42 to conceal both of them from view, as illustrated in FIG. 9. The offset portion 39 fits into the groove around the strap and the end 41 abuts the radially extending wall 34 to provide a neat and attractive appearance. The thickness of the central band portion 43 of the tie strap 42 is selected so that the tie strap, except at the connected ends, is fully contained within the recess 36. Preferably, the tie strap 42 is installed so that the connected ends 44 and 46 are located in an obscure location around the periphery of the projection 22 where the bulge created by such connection is not noticeable.

Figure 11:
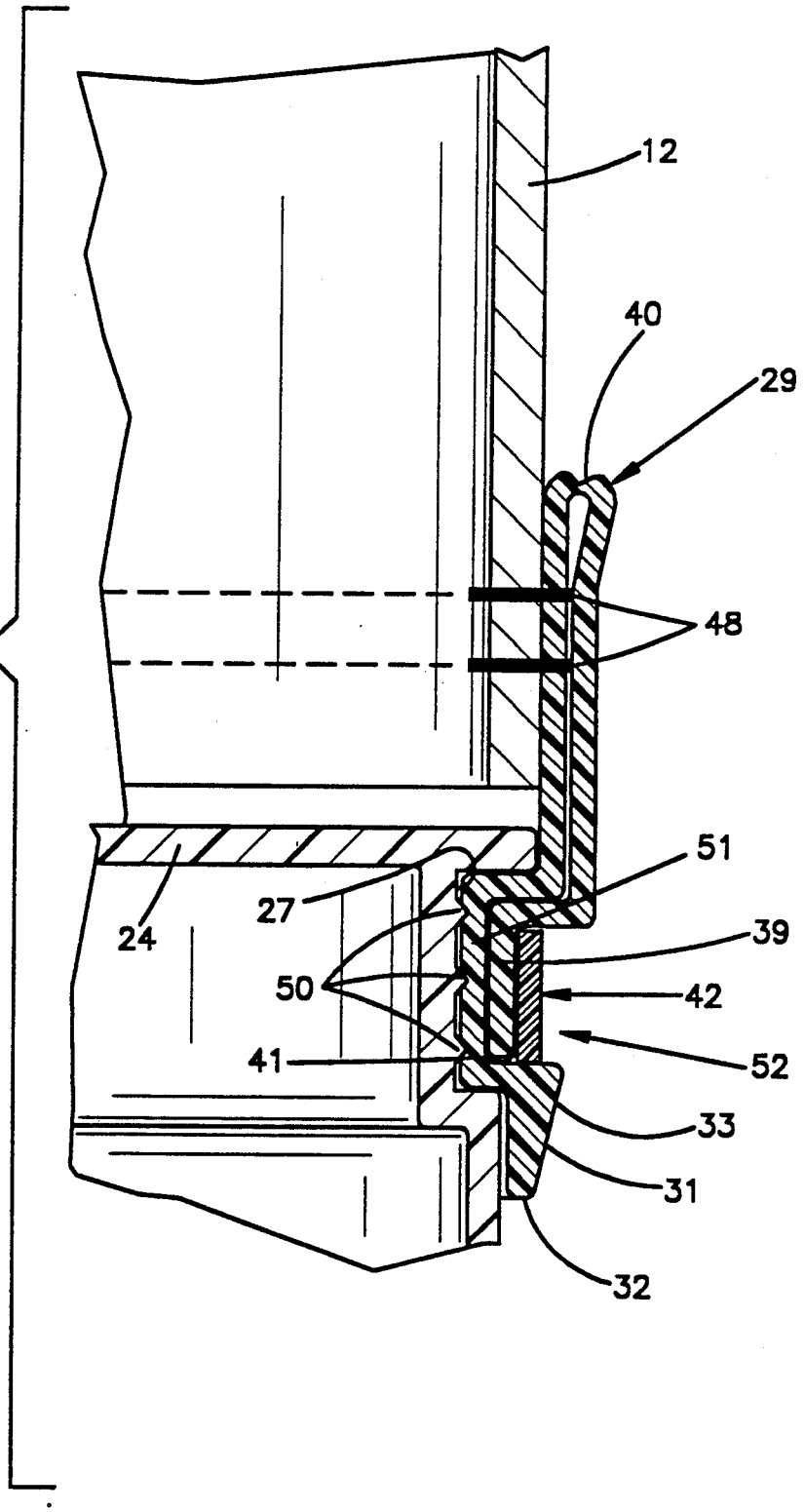

FIG. 11 illustrates the preferred commercial embodiment. The groove 27 has raised projections 50. The collar 29 is of a substantially uniform thickness end to end and has an indented portion 51 which corresponds to the groove 27. The collar 29 is folded back and end 41 has an offset wall portion 39 which folds over the indented portion 51. The portion 39 and indented portion 51 form a recess 52 which receives the strap 42 thereby allowing the mounted strap 42 to be flush with the mounted collar 29. The strap compresses the indented portion 51 against the projections 50 to effect a seal in the nature of a labyrinth seal.

Although the preferred embodiments of this invention have been shown and described, it should be understood that various modifications and rearrangements of the parts may be resorted to without departing from the scope of the invention as disclosed and claimed herein.

We claim:

1. An upright domestic vacuum cleaner comprising a housing assembly providing a mounting projection having an external surface for mounting a filter bag, a porous filter bag having an opening therein, a flexible collar secured to said bag around said opening and mounted on said external surface, said external surface and collar providing an interfitting structure locking said collar on said external surface, said flexible collar and mounting projection being sized so that said structure fails to provide a tight seal without separate clamping means, and a non-elastic tie strap on said collar around said collar providing said clamping means and pressing said interfitting structure into tight sealing engagement, said strap including permanently interconnected end portions of said tie strap and thereby permanently connecting said filter bag and said mounting projection.

2. A vacuum cleaner as set forth in claim 1, wherein said tie strap provides at one end a plurality of teeth and a socket at the other end, said socket including a plurality of spaced lateral strap portions supported at their ends and forming teeth at the other end of said strap engaging said teeth at said one end of said strap and permanently locking the ends of said tie strap together.

3. A vacuum cleaner as set forth in claim 2, wherein said teeth and lateral strap portions provide camming surface permitting insertion of said one end into said socket in one direction and preventing relative movement therebetween in the opposite direction.

4. A vacuum cleaner as set forth in claim 1, wherein said tie strap includes a central band portion having a first thickness, and a socket having a thickness approximately equal to three times said first thickness.

5. A vacuum cleaner as set forth in claim 1, wherein stitching secures said collar to said bag around said opening, and a band conceals said stitching from view.

6. A vacuum cleaner as set forth in claim 5, wherein said band also extends around said tie strap concealing said tie strap from view.

7. A vacuum cleaner as set forth in claim 5, wherein said band and collar are an integrally formed one-piece element, said band being connected to the remainder of said collar along one side of said stitching and said interfitting rib and recess.

8. A vacuum cleaner as set forth in claim 5, wherein said band is integrally formed with said collar and prior to installation on said projection extends in substantial alignment with the remainder of said collar, said band being folded back along the exterior of said remainder of said collar and forming therewith a smooth exterior extending to said fold.

9. A vacuum cleaner as set forth in claim 1, wherein said collar provides an exterior recess in which said tie strap is located, and a tapered end extending with increasing thickness to said recess, said collar providing a band folded back along said collar encircling said recess and providing an edge projection substantially abutting and blending with said tapered end around the side thereof adjacent to said recess.

10. A vacuum cleaner as set forth in claim 1, wherein said rib is formed on the interior of said collar and said groove is formed in said external surface, said rib being positioned in said groove.

11. The vacuum cleaner of claim 1 wherein the collar and mounting projection have an interfitting tongue and groove structure.

12. The vacuum cleaner of claim 11 wherein the strap is around the tongue and groove structure urging the two into tight interfitting engagement.

13. A non-disposable vacuum cleaner filter bag and mounting assembly for use in an upright domestic vacuum cleaner comprising a porous body having a first opening therein, a flexible collar mounted on said porous body around said first opening, said collar providing interfitting means operable to interfit with a mating structure on a vacuum cleaner for locking said filter bag thereon, said flexible collar being sized so that said interfitting means and said mating structure are sized to fail to provide a tight seal without separate clamping means, a non-elastic tie strap operable to extend around said interfitting means and provide said clamping means with tight sealing permanent engagement, said porous body also including a second opening and means for selectively closing and opening the second opening whereby to provide access for insertion and removal of a disposable filter bag.

14. A filter bag as set forth in claim 13, wherein said tie strap is formed of substantially nonelastic plastic having a toothed end and a socket end which interlock to permanently mount said tie strap.

15. A filter bag as set forth in claim 14, wherein said toothed end and socket cooperate to automatically lock said tie strap in a tightened condition when said tie strap is tightened around said collar.

16. A filter bag as set forth in claim 15, wherein said collar is stitched to the exterior of said body around said opening, and said collar provides a band which folds back along said collar and conceals said stitching.

17. A filter bag as set forth in claim 15, wherein said collar provides a band which folds back along said collar to conceal said tie strap.

18. A vacuum cleaner comprising a housing assembly providing a mounting projection having an external surface for mounting a filter bag, a porous filter bag having an opening therein, a flexible collar secured to said bag by stitching around said opening and mounted on said external surface, said external surface and collar on providing an interfitting rib and groove structure locking said collar on said external surface, said flexible collar and mounting projection being sized so that said rib and groove structure fails to provide a tight seal without separate clamping means, a tie strap on said collar around said interfitting rib and groove providing said clamping means pressing said interfitting rib and groove into tight sealing engagement, said strap providing teeth at each end which interfit and permanently connect the ends of said tie strap and thereby permanently connect said filter bag and said mounting projection, said collar including an integrally formed band concealing said stitching from view, said band being connected to the remainder of said collar along one side of said stitching and said interfitting rib and recess.

19. A vacuum cleaner comprising a housing assembly providing a mounting projection having an external surface for mounting a filter bag, a porous filter bag having an opening therein, a flexible collar secured to said bag by stitching around said opening and mounted on said external surface, said external surface and collar providing an interfitting rib and groove structure locking said collar on said external surface, said flexible collar and mounting projection being sized so that said rib and groove structure fails to provide a tight seal without separate clamping means, a tie strap on said collar around said interfitting rib and groove providing said clamping means pressing said interfitting rib and groove into tight sealing engagement, said strap providing teeth at each end which interfit and permanently connect the ends of said tie strap and thereby permanently connect said filter bag and said mounting projection, said collar including an integrally formed band concealing said stitching from view, said band prior to installation on said projection extending in substantial alignment with the remainder of said collar, and said band being folded back along the exterior of said remainder of said collar and forming therewith a smooth exterior extending to said fold.

20. A vacuum cleaner as set forth in claim 19, wherein said bag provides a closable opening, and a disposable bag is installed within said filter bag through said closable opening.

21. A vacuum cleaner as set forth in claim 19, wherein said housing assembly provides a powered fan and a discharge through which dirt-laden air passes, said discharge being connected to said disposable bag through said opening surrounded by said collar and isolated from the interior of said filter bag by said disposable bag.

22. A vacuum cleaner comprising a housing assembly providing a mounting projection having an external surface for mounting a filter bag, a porous filter bag having an opening therein, a flexible collar secured to said bag by stitching around said opening and mounted on said external surface, said external surface and collar providing an interfitting rib and groove structure locking said collar on said external surface, said flexible collar and mounting projection being sized so that said rib and groove structure fails to provide a tight seal without separate clamping means, a tie strap on said collar around said interfitting rib and groove providing said clamping means pressing said interfitting rib and groove into tight sealing engagement, said strap providing teeth at each end which interfit and permanently connect the ends of said tie strap and thereby permanently connect said filter bag and said mounting projection, said collar having an exterior recess in which said tie strap is located, and said collar also having a tapered end extending with increasing thickness to said recess, said collar providing a band folded back along said collar encircling said recess and providing an edge projection substantially abutting and blending with said tapered end around the size thereof adjacent to said recess.

23. A nondisposable vacuum cleaner filter bag and mounting assembly comprising a porous body having an opening therein, a flexible collar mounted on said porous body around said opening, said collar providing interfitting means operable to interfit with a mating structure on a vacuum cleaner for locking said filter bag thereon, said flexible collar being sized so that said interfitting means and said mating structure are sized to fail to provide a tight seal without separate clamping means, a nonelastic plastic tie strap operable to extend around said interfitting means and provide said clamping means to permanently lock said collar on said vacuum cleaner with tight sealing engagement, said tie strap having a toothed end and a socket end which interlock to permanently mount said tie strap, said toothed end and socket cooperate to automatically lock said tie strap in a tightened condition when said tie strap is tightened around said collar, said collar being stitched to the exterior of said body around said opening, and said collar providing a band which folds back along said collar and conceals said stitching.

24. A filter bag as set forth in claim 23, wherein said collar provides a recess around said interfitting means sized to receive said tie strap.

25. A nondisposable vacuum cleaner filter bag and mounting assembly comprising a porous body having an opening therein, a flexible collar mounted on said porous body around said opening, said collar providing interfitting means operable to interfit with a mating structure on a vacuum cleaner for locking said filter bag thereon, said flexible collar being sized so that said interfitting means and said mating structure are sized to fail to provide a tight seal without separate clamping means, a nonelastic plastic tie strap operable to extend around said interfitting means and provide said clamping means to permanently lock said collar on said vacuum cleaner with tight sealing engagement, said tie strap having a toothed end and a socket end which interlock to permanently mount said tie strap, said toothed end and socket cooperate to automatically lock said tie strap in a tightened condition when said tie strap is tightened around said collar, and said collar providing a band which folds back along said collar to conceal said tie strap.

26. A filter bag as set forth in claim 25, wherein said interfitting means is a rib on the interior of said collar, and said collar is plastic and provides a thinned hinge portion producing a relatively compact fold when said band is folded back along said collar.

27. A vacuum cleaner comprising:

a) a housing assembly providing a mounting projection element having an external surface for mounting a filter bag element;

b) a flexible collar element mounted on said external surface, said external surface and collar element having interfitting structure locating said collar on said external surface;

c) a porous filter bag element having an opening therein, the bag element being connected to the projection and collar elements with its opening in air flow relationship with the assembly;

d) a tie strap on said collar providing clamping means pressing at least two of said elements into a tight sealing engagement connection permanently connecting said elements; and, e) said collar including an integrally formed band concealing at least one element connection from view, said band being connected to the remainder of said collar along one side of said bag element adjacent to the projection and collar elements connection.

28. The vacuum cleaner of claim 27 wherein said band prior to installation on said projection extends in substantial alignment with the remainder of said collar, and said band is folded back along the exterior of said remainder of said collar and forming therewith a smooth exterior extending to said fold.

29. The vacuum cleaner of claim 28 wherein said collar has an exterior recess in which said tie strap is located, and said collar also has a tapered end extending with increasing thickness to said recess, said band encircling said recess and providing an edge projection substantially abutting and blending with said tapered end around the side thereof adjacent to said recess.

30. A vacuum cleaner as set forth in claim 27, wherein said bag provides a closable opening, and a disposable bag is installed within said filter bag through said closable opening.

31. A vacuum cleaner as set forth in claim 27, wherein said housing assembly provides a powered fan and a discharge through which dirt-laden air passes, said discharge being connected to a disposable bag through said opening surrounded by said collar and isolated from the interior of said filter bag by said disposable bag.

32. A nondisposable vacuum cleaner filter bag and mounting assembly comprising a porous body having an opening therein, a flexible collar mounted on said porous body around said opening, said collar providing mounting means operable to connect with a mating structure on a vacuum cleaner for connecting said filter bag thereto, a nonelastic tie strap operable to extend around said mounting means and permanently lock said collar on said vacuum cleaner with tight sealing engagement, said collar and said body having a permanent connection around said opening, and said collar providing a band which folds back along said collar and conceals said permanent connection.

33. A nondisposable vacuum cleaner filter bag and mounting assembly comprising a porous body having an opening therein, a flexible collar mounted on said porous body around said opening, said collar providing mounting means operable to connect with a mating structure on a vacuum cleaner for connecting said filter bag thereto, a nonelastic plastic tie strap operable to extend around said mounting means to permanently lock said collar on said vacuum cleaner with tight sealing engagement, and said collar providing a band which folds back along said collar to conceal said tie strap.

34. The filter bag as set forth in claim 33 wherein the mounting means is an interfitting means and wherein said interfitting means is a rib on the interior of said collar, and said collar is plastic and provides a thinned hinge portion producing a relatively compact fold when said band is folded back along said collar.

35. A filter bag as set forth in claim 33, wherein said collar provides a recess around said interfitting means sized to receive said tie strap.

36. For use in a vacuum sweeper of the type having both disposable and non-disposable filters, a filter subassembly comprising:

a) a non-disposable filter bag having an inlet opening and a recloseable access opening;

b) a tubular mounting collar in telescopic relationship with portions of the bag defining the inlet opening;

c) said bag and collar having a permanent interconnection; and, d) said collar including a band portion foldable over another collar portion to conceal said permanent interconnection.

37. The subassembly of claim 36 wherein the permanent interconnection comprises stitching.

38. The subassembly of claim 36 wherein the collar includes a weakened portion between the band and the interconnection to delineate the situs of a fold when the band is folded over said another collar portion.

39. A collar for use in coupling a nondisposable bag to vacuum sweeper assembly comprising:

a) an elongate, tubular flexible body having a through fluid passage;

b) the body including a mounting portion adjacent one end, the mounting portion including an inwardly projecting rib for interfit with a filter bag mounting of a sweeper assembly;

c) the collar including a locking bank receiving recess positioned to overlie the rib when the collar is in use and for receipt of an inelastic, permanently mounted, collar securement, tie strap;

d) the collar including a bank portion remote from the one end and near the other end;

e) the collar including a fold locating recess in an inner surface, the locating recess being positioned to locate a fold when the band portion is folded back to overlie other parts of the collar and project from the fold toward said one end; and, f) the collar including a bag securement portion for connection to an inlet end portion of a non-disposable filter bag.

* * * * *